US009879858B2

(12) United States Patent
Goodson et al.

(10) Patent No.: US 9,879,858 B2
(45) Date of Patent: Jan. 30, 2018

(54) INERTIAL ELECTRODE AND SYSTEM CONFIGURED FOR ELECTRODYNAMIC INTERACTION WITH A FLAME

(71) Applicant: ClearSign Combustion Corporation, Seattle, WA (US)

(72) Inventors: David B. Goodson, Bellevue, WA (US); Tracy A. Prevo, Seattle, WA (US); Joseph Colannino, Bellevue, WA (US); Robert E. Breidenthal, Seattle, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 1433 days.

(21) Appl. No.: 13/731,095

(22) Filed: Dec. 30, 2012

(65) Prior Publication Data

US 2013/0230810 A1 Sep. 5, 2013

Related U.S. Application Data

(60) Provisional application No. 61/605,691, filed on Mar. 1, 2012.

(51) Int. Cl.

| | |
|---|---|
| ***F23L 7/00*** | (2006.01) |
| ***F23D 99/00*** | (2010.01) |
| ***F23C 99/00*** | (2006.01) |
| ***F23D 14/84*** | (2006.01) |

(52) U.S. Cl.

CPC ..... *F23L 7/00* (2013.01); *F23C 99/001* (2013.01); *F23D 14/84* (2013.01); *F23D 21/00* (2013.01)

(58) Field of Classification Search

USPC ..... 431/4

See application file for complete search history.

(56) References Cited

U.S. PATENT DOCUMENTS

| | | | | |
|---|---|---|---|---|
| 1,153,182 A | | 9/1915 | Schniewind | |
| 2,604,936 A | | 7/1952 | Kaehni et al. | |
| 3,087,472 A | | 4/1963 | Asakawa | |
| 3,167,109 A | | 1/1965 | Wobig | |
| 3,224,485 A | | 12/1965 | Blomgren et al. | |
| 3,306,338 A | * | 2/1967 | Wright | F23C 99/001 361/233 |
| 3,358,731 A | | 12/1967 | Donnelly | |

(Continued)

FOREIGN PATENT DOCUMENTS

| | | |
|---|---|---|
| EP | 0844434 | 5/1998 |
| EP | 1139020 | 8/2006 |

(Continued)

OTHER PUBLICATIONS

Altendrfner et al., "Electric Field Effects on Emissions and Flame Stability With Optimized Electric Field Geometry", Third European Combustion Meeting ECM 2007, p. 1-6.

(Continued)

*Primary Examiner* — Gregory Huson
*Assistant Examiner* — Martha Becton
(74) *Attorney, Agent, or Firm* — Christopher A. Wiklof; Nicholas S. Bromer; Launchpad IP, Inc.

(57) ABSTRACT

An inertial electrode launcher may be configured to project charged particles or a voltage comprising an inertial electrode proximate a flame or combustion gas produced by the flame.

44 Claims, 6 Drawing Sheets

(56) References Cited

U.S. PATENT DOCUMENTS

| | | | | |
|---|---|---|---|---|
| 3,416,870 | A | 12/1968 | Wright | |
| 3,503,348 | A | 3/1970 | Dvirka | |
| 3,749,545 | A | 7/1973 | Velkoff | |
| 3,841,824 | A | 10/1974 | Bethel | |
| 3,869,362 | A | 3/1975 | Machi et al. | |
| 4,020,388 | A | 4/1977 | Pratt, Jr. | |
| 4,052,139 | A | 10/1977 | Paillaud et al. | |
| 4,091,779 | A | 5/1978 | Saufferer et al. | |
| 4,093,430 | A | 6/1978 | Schwab et al. | |
| 4,110,086 | A | 8/1978 | Schwab et al. | |
| 4,111,636 | A | 9/1978 | Goldberg | |
| 4,118,202 | A | 10/1978 | Scholes | |
| 4,159,786 | A | 7/1979 | Biddle, III et al. | |
| 4,219,001 | A | 8/1980 | Kumagai et al. | |
| 4,260,394 | A | 4/1981 | Rich | |
| 4,304,096 | A | 12/1981 | Liu et al. | |
| 4,340,024 | A | 7/1982 | Suzuki et al. | |
| 4,402,036 | A * | 8/1983 | Hensley | F02P 7/03 313/138 |
| 4,439,980 | A | 4/1984 | Biblarz et al. | |
| 4,576,029 | A | 3/1986 | Miyake et al. | |
| 4,649,260 | A | 3/1987 | Melis et al. | |
| 4,675,029 | A | 6/1987 | Norman et al. | |
| 4,903,616 | A | 2/1990 | Mavroudis | |
| 4,987,839 | A | 1/1991 | Krigmont et al. | |
| 5,158,449 | A | 10/1992 | Bryan et al. | |
| 5,702,244 | A | 12/1997 | Goodson et al. | |
| 5,802,854 | A * | 9/1998 | Maeda | F23R 3/346 60/39.821 |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 | 11/2006 | Branston et al. | |
| 7,159,646 | B2 | 1/2007 | Dessiatoun et al. | |
| 7,168,427 | B2 | 1/2007 | Bachinski et al. | |
| 7,182,805 | B2 | 2/2007 | Reaves | |
| 7,226,496 | B2 | 6/2007 | Ehlers | |
| 7,226,497 | B2 | 6/2007 | Ashworth | |
| 7,243,496 | B2 | 7/2007 | Pavlik et al. | |
| 7,377,114 | B1 | 5/2008 | Pearce | |
| 7,481,043 | B2 * | 1/2009 | Hirata | B01D 53/90 239/133 |
| 7,523,603 | B2 | 4/2009 | Hagen et al. | |
| 7,845,937 | B2 | 12/2010 | Hammer et al. | |
| 8,082,725 | B2 | 12/2011 | Younsi et al. | |
| 8,245,951 | B2 | 8/2012 | Fink et al. | |
| 8,267,063 | B2 * | 9/2012 | McAlister | F02D 41/38 123/297 |
| 8,746,197 | B2 * | 6/2014 | McAlister | F02M 57/06 123/143 B |
| 8,851,882 | B2 * | 10/2014 | Hartwick | F23C 99/001 431/2 |
| 8,881,535 | B2 * | 11/2014 | Hartwick | F23D 14/84 431/8 |
| 9,151,549 | B2 * | 10/2015 | Goodson | F15D 1/02 |
| 9,169,814 | B2 * | 10/2015 | McAlister | F02M 57/06 |
| 9,169,821 | B2 * | 10/2015 | McAlister | F02M 57/06 |
| 9,209,654 | B2 * | 12/2015 | Colannino | F23C 99/001 |
| 9,267,680 | B2 * | 2/2016 | Goodson | F23G 5/442 |
| 9,366,427 | B2 * | 6/2016 | Sonnichsen | F23B 7/00 |
| 9,377,190 | B2 * | 6/2016 | Karkow | F23D 14/74 |
| 9,441,834 | B2 * | 9/2016 | Colannino | F23C 99/001 |
| 9,494,317 | B2 * | 11/2016 | Krichtafovitch | F02P 7/00 |
| 2002/0092302 | A1 * | 7/2002 | Johnson | F23C 99/00 60/737 |
| 2005/0208442 | A1 | 9/2005 | Heiligers et al. | |
| 2006/0165555 | A1 | 7/2006 | Spielman et al. | |
| 2007/0020567 | A1 | 1/2007 | Branston et al. | |
| 2007/0172780 | A1 | 7/2007 | Lugnet et al. | |
| 2010/0183424 | A1 | 7/2010 | Roy | |
| 2011/0027734 | A1 | 2/2011 | Hartwick et al. | |
| 2011/0072786 | A1 | 3/2011 | Tokuda et al. | |
| 2011/0126548 | A1 * | 6/2011 | Hammer | F23C 99/001 60/775 |
| 2011/0203771 | A1 | 8/2011 | Goodson et al. | |
| 2011/0225948 | A1 * | 9/2011 | Valeev | F23C 99/001 60/39.821 |
| 2012/0199088 | A1 * | 8/2012 | Burrows | F02P 9/007 123/143 B |
| 2012/0210968 | A1 * | 8/2012 | Burrows | H01T 13/50 123/143 B |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |
| 2013/0291552 | A1 | 11/2013 | Smith et al. | |
| 2014/0020666 | A1 * | 1/2014 | Plotnikov | F02P 23/04 123/606 |
| 2014/0038113 | A1 * | 2/2014 | Breidenthal | F23N 5/16 431/2 |
| 2014/0208758 | A1 | 7/2014 | Breidenthal et al. | |
| 2014/0255856 | A1 * | 9/2014 | Colannino | F23N 5/00 431/2 |
| 2014/0338350 | A1 | 11/2014 | Breidenthal | |
| 2015/0147706 | A1 * | 5/2015 | Krichtafovitch | F23N 5/00 431/253 |
| 2015/0338089 | A1 * | 11/2015 | Krichtafovitch | F23N 5/00 431/8 |
| 2016/0123576 | A1 | 5/2016 | Colannino et al. | |

FOREIGN PATENT DOCUMENTS

| | | |
|---|---|---|
| EP | 2738460 | 6/2014 |
| FR | 2577304 | 12/1989 |
| GB | 932955 | 7/1963 |
| GB | 1042014 | 9/1966 |
| JP | 58-019609 | 2/1983 |
| JP | 60-216111 | 10/1985 |
| JP | 61-265404 | 11/1986 |
| JP | 2001-021110 | 1/2001 |
| WO | WO 1996/001394 | 1/1996 |
| WO | WO 2013/181569 | 12/2013 |

OTHER PUBLICATIONS

William T. Brande; "The Bakerian Lecture: On Some New Electro-Chemical Phenomena", Phil. Trans. R. Soc. Lond. 1814 104, p. 51-61.

James Lawton and Felix J. Weinberg. "Electrical Aspects of Combustion". Clarendon Press, Oxford. 1969.

PCT International Search Report and Written Opinion of PCT Application No. PCT/US2012/072250 dated Mar. 8, 2013.

M. Zake et al., "Electric Field Control of NOx Formation in the Flame Channel Flows." Global Nest: The Int. J. May 2000, vol. 2, No. 1, pp. 99-108.

F. Altendorfner et al., Electric Field Effects on Emissions and Flame Stability with Optimized Electric Field Geometry, The European Combustion Meeting ECM 2007, 2007, 1-6, Germany.

* cited by examiner

INERTIAL ELECTRODE AND SYSTEM CONFIGURED FOR ELECTRODYNAMIC INTERACTION WITH A FLAME

CROSS REFERENCE TO RELATED APPLICATIONS

The present application claims priority benefit from U.S. Provisional Patent Application No. 61/605,691, entitled "INERTIAL ELECTRODE AND SYSTEM CONFIGURED FOR ELECTRODYNAMIC INTERACTION WITH A FLAME", filed Mar. 1, 2012; which, to the extent not inconsistent with the disclosure herein, is incorporated by reference.

SUMMARY

According to an embodiment, a burner system may include a burner configured to support a flame, the flame or a combustion gas produced by the flame carrying a majority of first charged particles having a first sign. The embodiment may further include at least one inertial electrode launcher that may be configured to launch an inertial electrode in proximity to the flame or the combustion gas produced by the flame. The inertial electrode may include charged particles or it may carry a voltage. The inertial electrode may be configured to affect a shape or location of the flame and/or affect a concentration or distribution of the charged particles in the flame or the combustion gas produced by the flame.

According to another embodiment, a method for operating a burner system may include supporting a flame with a burner and launching an inertial electrode carrying charged particles or a voltage in proximity to the flame or to a combustion gas produced by the flame. The method may include selecting a charge sign or a voltage for the inertial electrode. The sign or charge may include a sequence of different charge signs or voltages. The inertial electrode may affect the flame or the combustion gas produced by the flame.

DETAILED DESCRIPTION

Figure 1:
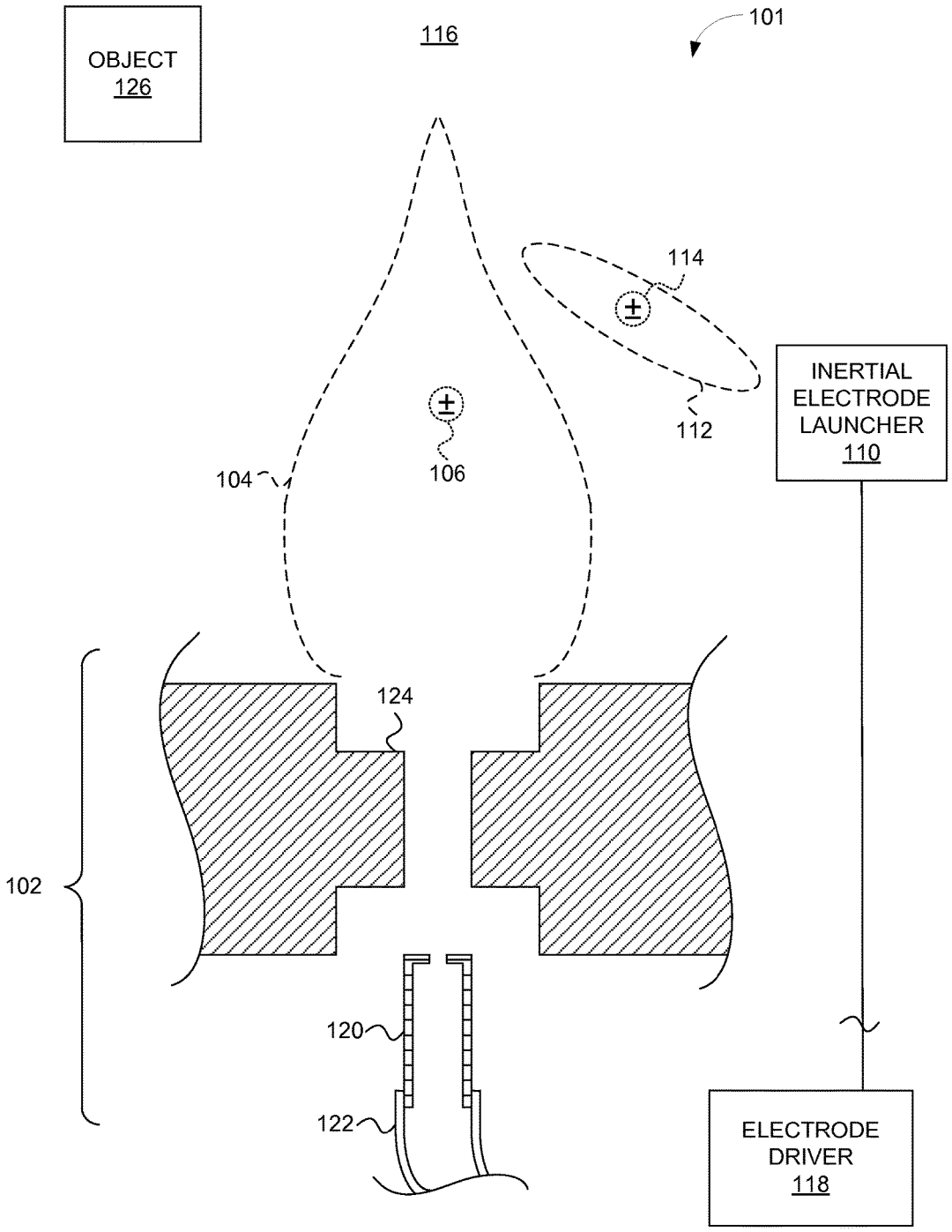
FIG. 1 is a diagram of a burner system including an inertial electrode launcher, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram of a burner system 101 including a burner 102 configured to support a flame 104 and at least one inertial electrode launcher 110 configured to launch an inertial electrode 112 in proximity to the flame 104 or combustion gas 116 produced by the flame. The flame 104 or combustion gas 116 produced by the flame 104 may carry first charged particles 106. The inertial electrode 112 may include charged particles 114 and/or may carry a voltage. The inertial electrode launcher 110 is configured to impart momentum onto the inertial electrode 112. The momentum imparted onto the inertial electrode 112 and/or the charged particles 114 and/or voltage carried by the inertial electrode 112 may be selected to cause the flame 104 or the combustion gas 116 to respond to the momentum, the charged particles 114, and/or the voltage carried by the inertial electrode 112.

The momentum imparted onto the inertial electrode 112, the charged particles 114, and/or the voltage carried by the inertial electrode 112 may be selected to cause the first charged particles 106 carried by the flame 104 or a combustion gas 116 to respond to the momentum and to the charged particles 114 or voltage carried by the inertial electrode 112. Acceleration imparted on the charged particles 106 may be transferred to uncharged particles in the flame 104 or the combustion gas 116 to produce an overall movement of the flame, change a reaction rate of the flame, flatten the flame, lengthen the flame, bend the flame, affect a location of the flame 104, direct the flame 104 or combustion gas 116, or otherwise affect the flame 104 or combustion gas 116.

According to an embodiment, the inertial electrode may be selected to impart a majority charge on the flame 104 or on the combustion gas 116 produced by the flame 104.

As indicated above, the inertial electrode 112 may be configured to affect a shape or location of the flame 104 and/or to affect a concentration or distribution of the charged particles 106 in the flame 104 or combustion gas 116 produced by the flame 104.

Optionally, the inertial electrode launcher 110 and inertial electrode 112 may respectively include a plurality of inertial electrode launchers 110 and inertial electrodes 112.

An electrode driver 118 may be configured to drive, i.e., to control and operate one or more of the functions or operations performed by the inertial electrode launcher(s) 110. The electrode driver 118 may be configured to periodically or intermittently cooperate with the inertial electrode launcher 110 to change a concentration of the charged particles 114 or the voltage carried by the inertial electrode 112. For example, the electrode driver 118 may be configured to periodically or intermittently change a sign of the charged particles 114 or the voltage carried by the inertial electrode 112.

Optionally, the inertial electrode launcher 110 may include or be coupled to a directional actuator (not shown) configured to determine a direction in which the inertial electrode 112 is launched by the inertial electrode launcher 110. The electrode driver 118 may be further configured to control the directional actuator. Optionally, the inertial electrode launcher 110 may include a location actuator (not shown) configured to determine a location from which the inertial electrode 112 is launched by the inertial electrode launcher 110. The electrode driver 118 may be configured to control the location actuator.

The burner 102 may include a fuel source 120, configured to provide fuel for the flame 104, and an insulator or gap 122, configured to isolate charges 106 in the flame 104 and charges 114 or voltage carried by the inertial electrode 112 from ground. A flame holder 124 may be configured to hold the flame 104. For example, the flame holder 124 may be referred to as a bluff body.

The flame 104 may be a diffusion flame, for example. Alternatively, the burner 102 may be configured to at least partially premix the fuel and an oxidizer such as oxygen contained in air.

The burner system 101 may include or be operatively coupled to an object 126 selected to be heated by or selected to be protected from heating by the flame 104 or the combustion gas 116 produced by the flame 104. For example, the object 126 may include a furnace wall, a boiler wall, a combustor wall, a heat transfer surface, an air-to-air heat exchanger, an air-to-liquid heat exchanger, a chemical reactor, a sensor, a turbine blade, a fireplace, and/or an object in an environment exposed to the flame 104 or to combustion gas 116 produced by the flame 104. The inertial electrode launcher 110 may be configured to launch an inertial electrode 112 carrying charges 114 or a voltage selected to cause the flame 104 or combustion gas 116 produced by the flame 104 to transfer relatively more heat to the object 126. Alternatively, the inertial electrode launcher 110 may be configured to cause the flame 104 or the combustion gas 116 to transfer relatively less heat to the object 126. The object 126 may be electrically grounded or may be driven to a voltage. For example, the object 126 may be driven to or held at a voltage having an opposite sign compared to the sign of the charges 114 or the voltage carried by the inertial electrode 112. Alternatively, the object 126 may be driven to or held at a voltage having the same sign compared to the sign of the charges or the voltage carried by the inertial electrode 112. According to other embodiments, the object 126 may be insulated from ground and not driven to a voltage different than a voltage imparted by cooperation of the inertial electrode 112 with the flame 104. For example, the object 126 may follow an AC or chopped DC waveform applied by the electrode controller 118.

Various assemblies are contemplated with respect to embodiments of the inertial electrode launcher 110.

Figure 2:
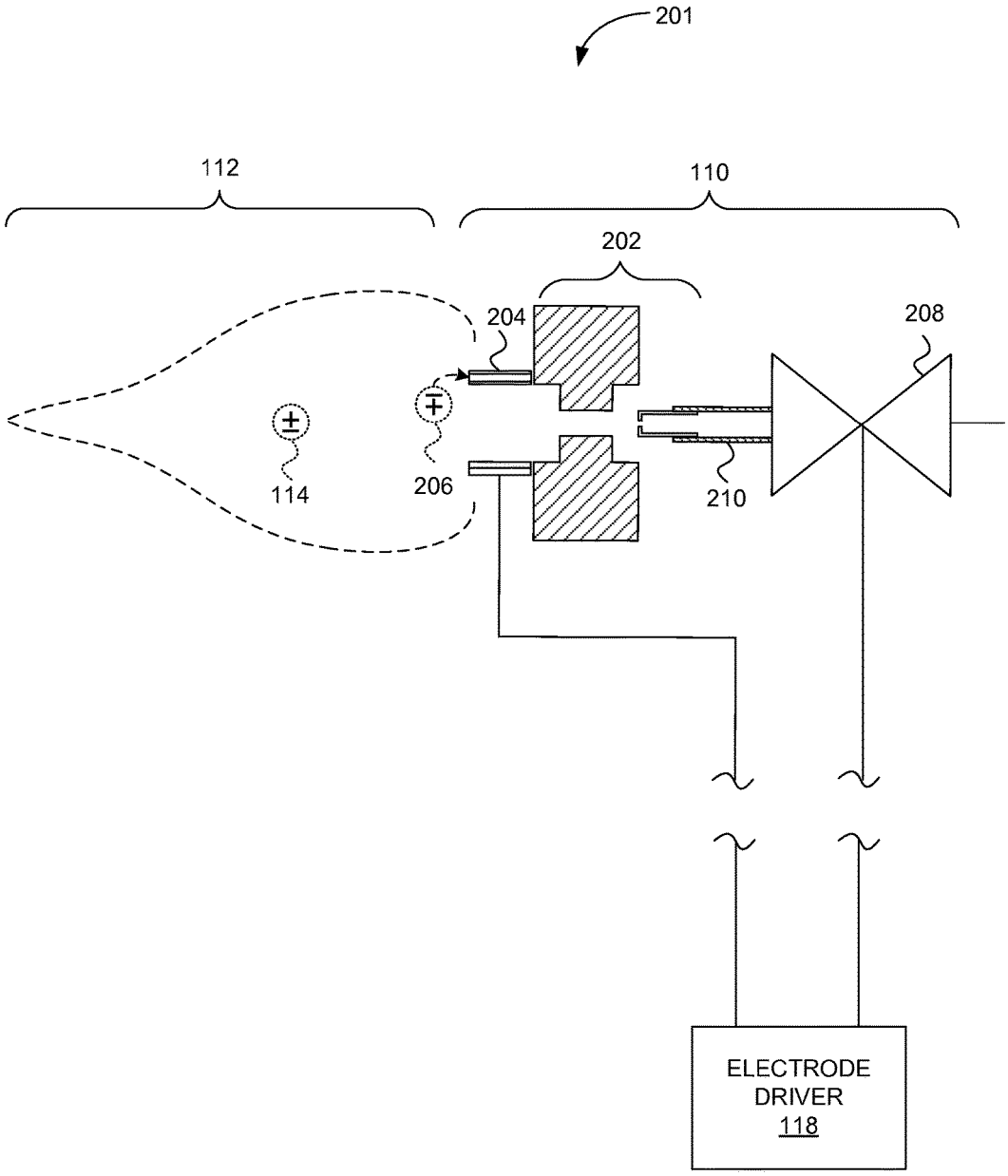
FIG. 2 is a diagram of an inertial electrode launcher including an inertial electrode burner configured to support inertial electrode formed from a flame, according to an embodiment.

FIG. 2 is a diagram showing an embodiment including an apparatus 201 configured to support a flame that acts as inertial electrode 112. An inertial electrode burner 202 may at least intermittently or periodically support inertial electrode 112. An inertial electrode launcher charging apparatus 204 may be configured to attract from the inertial electrode 112 charges 206 to create a majority sign of the charged particles 114 carried by the inertial electrode 112 or to add the majority sign charges to the inertial electrode 112. In an embodiment, the charging apparatus 204 may include a depletion electrode (not shown) energized to the same polarity as the desired majority sign charges. Mobility of the inertial electrode charged particles 114 carried by the flame 112 may cause the inertial electrode 112 to carry a measurable voltage.

For example, the charging apparatus 204 may be driven to a positive voltage, attracting negative charges 206 to the charging apparatus 204, leaving positive majority charges 114 in the inertial electrode 112, or at least a portion of the inertial electrode 112. Conversely, if the charging apparatus 204 is driven to a negative voltage, positive charges 206 may be attracted to the charging apparatus electrode 204, leaving negative majority charges 114 in the inertial electrode 112. Alternatively, the charging apparatus 204 may be configured to output the majority charges to the inertial electrode 112. For example, the charging apparatus 204 may be formed as a corona electrode configured to eject charges having the same sign as the desired inertial electrode 112 majority charge.

The charging apparatus 204 may be formed by at least a portion of a boiler wall, or other structure associated with the function of the burner. Alternatively, the charging apparatus 204 may be an extrinsic structure introduced into a burner volume through an air gap or insulated and/or shielded sleeve. According to other embodiments, the charging apparatus 204 may be formed by the inertial electrode burner 202 or by an electrical conductor intrinsic to the inertial electrode burner 202.

The electrode driver 118 may be configured to apply a voltage to the charging apparatus 204 to control at least one of the sign or concentration of the charged particles 114 in the inertial electrode 112.

A valve 208 may be configured to control a flow of fuel to the inertial electrode burner 202. The electrode driver 118 may be configured to control the valve 208. An igniter or pilot (not shown) may be configured to ignite the inertial electrode 112 when the valve 208 is opened. An electrical insulator or gap 210 may be configured to electrically isolate the inertial electrode 112 from ground or another voltage.

Referring to FIGS. 1 and 2, the burner system 101 and the inertial electrode burner 202 may be configured according to a "flame-on-flame" architecture where the inertial electrode burner 202 imparts a charge on the flame 104 and/or anchors the flame 104. For example, the inertial electrode burner 202 may be arranged to be protected from a fluid flow past the burner 102. The inertial electrode 112 may be configured as a flame holder for flame 104 subject to higher velocity fluid flow. The arrangement for protection of the inertial electrode burner 202 from the fluid flow past the burner 102 may include positioning the inertial electrode burner 202 in the lee of a physical fluid flow barrier (not shown).

Figure 3:
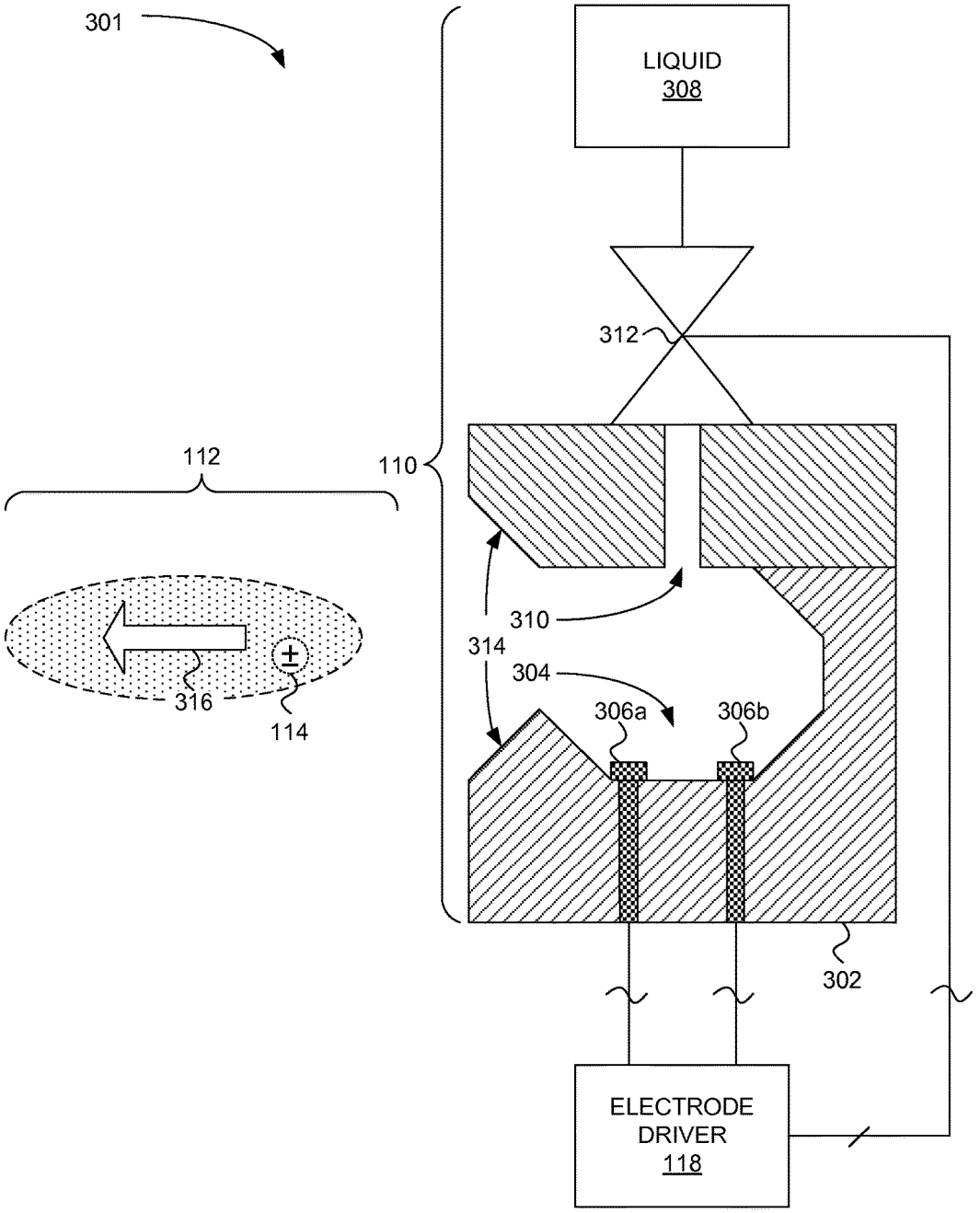
FIG. 3 is a diagram of an inertial electrode launcher configured to vaporize a liquid and to launch an inertial electrode including a vapor and/or an aerosol formed from the liquid, according to an embodiment.

FIG. 3 is a diagram of an inertial electrode launcher embodiment 301 where an inertial electrode launcher is configured to project an inertial electrode 112 that may include a charged vapor, aerosol or a vapor and aerosol. A body 302 may define a vaporization well 304. First and second electrodes 306*a*, 306*b* operatively coupled to an electrode driver 118 may be configured to apply a high voltage to a liquid 308, at least temporarily confined by the vaporization well 304, to vaporize the liquid 308 and to produce a inertial electrode 112 including vapor, aerosol, or vapor and aerosol of the liquid 308 carrying charged particles 114. The electrode driver 118 may be configured to apply the high voltage with a voltage bias having a same sign as a sign of charge carried by a majority of the charged particles 114 carried by the inertial electrode 112.

A flow passage 310 may be configured to admit the liquid or other vaporizing material 308 to the vaporization well 304. A valve or actuator 312 may be configured to enable a flow of the liquid 308 through the fluid flow passage 310 to the vaporization well 304. The valve or actuator 312 may be operatively coupled to the electrode driver 118. The inertial electrode launcher 110 may include a nozzle 314 configured to determine a direction of travel 316 of a vapor, an aerosol, or a vapor and aerosol of the vaporizing material 308 forming the inertial electrode 112. An actuator (not shown) may be configured to align the nozzle 314 to an intended direction of travel 316 of the vapor, aerosol, or vapor and aerosol of the liquid 308 forming the inertial electrode 112. The actuator (not shown) may be operatively coupled to the electrode driver 118.

The vaporizing material 308 may include a liquid such as water. The liquid may also include a buffer solution or be at least partly functionalized to hold the charge 114. The bias voltage may be positive at least intermittently or periodically. A majority of the charged particles 114 may carry a positive charge at least intermittently or periodically corresponding to the (positive) bias voltage. Alternatively, the bias voltage may be negative at least intermittently or periodically. A majority of the charged particles 114 may carry a negative charge at least intermittently or periodically corresponding to the (negative) bias voltage.

Figure 4:
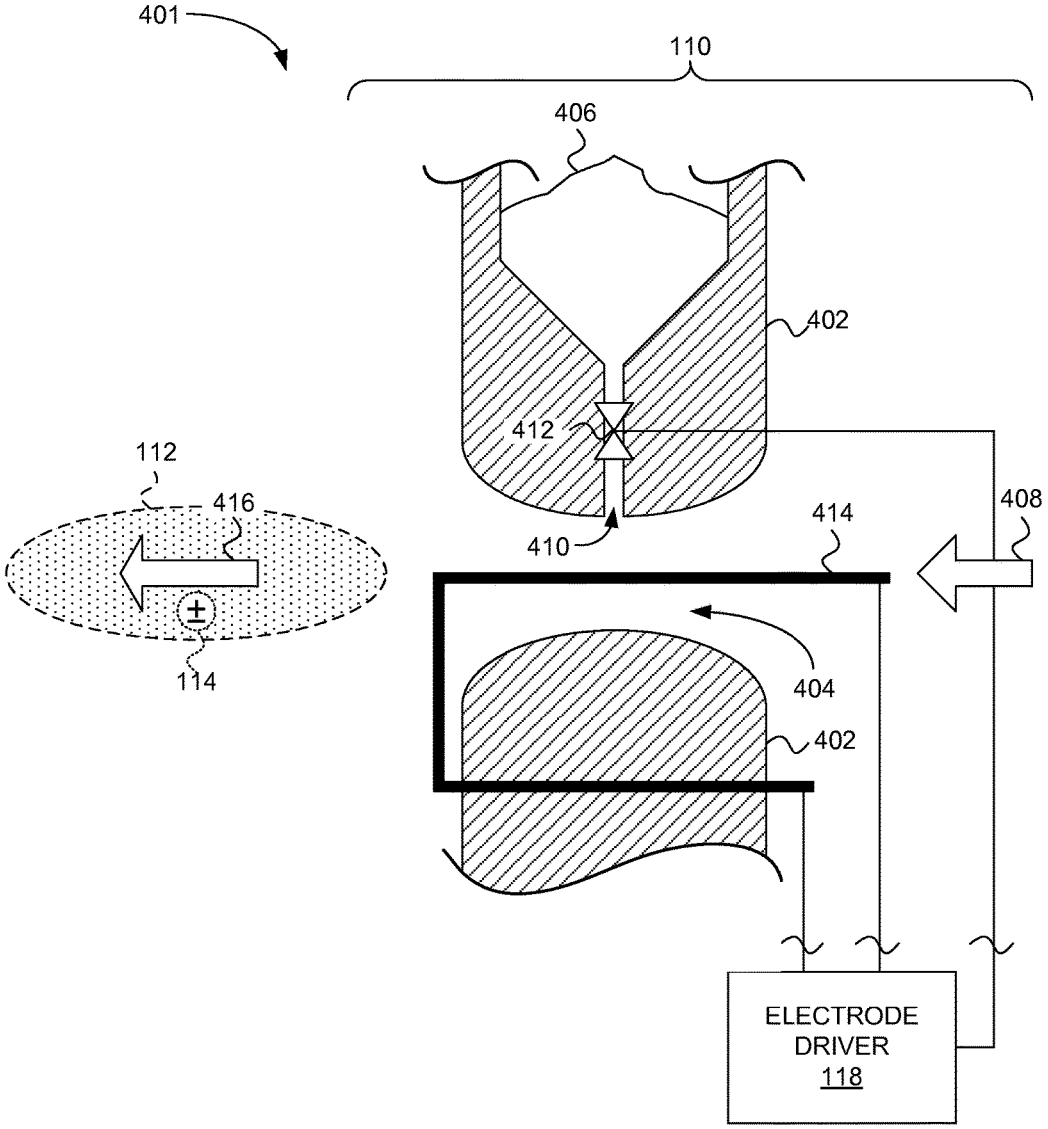
FIG. 4 is a diagram of an inertial electrode launcher configured to launch an inertial electrode including projected charged solid particles, according to an embodiment.

FIG. 4 is a diagram of an embodiment of an inertial electrode launcher configured to project solid particles 406 to a location proximate the flame 104 or combustion gas 116 produced by flame 104. A body 402 may define an orifice 404 from which the solid particles 406 are projected. The projected solid particles 406 may include at least one or more charged particles 114 to form a charged solid particle (not shown), wherein one or more of the charged solid particles may form the inertial electrode 112.

The body 402 may include a wall of a furnace or boiler. The body 402 may include refractory material. The orifice 404 may include a Venturi passage, for example. The solid particles 406 may be configured to be projected by an entrainment fluid 408 passing through the orifice 404. The entrainment fluid 408 may include air. Additionally or alternatively, the entrainment fluid 408 may include an overfire oxidizer.

A particle channel 410 may be positioned adjacent to the orifice 404. The solid particles 406 may be injected into a passing entrainment fluid at the orifice 404 through the particle channel 410. The electrode driver 118 may be operatively coupled to the inertial electrode launcher 401. The particle valve 412 may be operatively coupled to the electrode driver 118. The electrode driver 118 may be configured to control at least one of a rate of flow of particles through the particle channel 410 or a periodic or intermittent particle flow through the particle channel 410. A corona surface 414 may be configured to be driven to a sufficiently high voltage to cause an emission of charges. At least some of the charges emitted by the corona may be deposited on at least some of the solid particles 406 to form the charged solid particles. The corona surface 414 may include a corona wire (not shown), a corotron (not shown), and/or a scorotron (not shown). The electrode driver 118 may be configured to control the voltage to which the corona surface 414 is driven.

Referring to FIGS. 1 and 4, a voltage sign to which the corona surface 414 is driven and the charge sign of the majority charged particles 114 carried by the inertial electrode 112 may be the same as a voltage carried by an object 126. Alternatively, the voltage sign to which the corona surface 414 is driven and the charge sign of the majority charged particles 114 carried by the inertial electrode 112 may be opposite to a voltage carried by the object 126.

An actuator (not shown) may be configured to align the orifice 404 to an intended direction of travel 416 of the charged solid particles (not shown) that include solid particle 406 and the at least one or more charge particle 114 forming the inertial electrode 112. The actuator may be operatively coupled to the electrode driver 118. One or more steering electrodes (not shown) may be operatively coupled to the electrode driver 118. The electrode driver 118 may be configured to energize the one or more steering electrodes (not shown) to deflect the charged solid particles (not shown) forming the inertial electrode 112 toward an intended direction of travel 416.

Optionally, the orifice 404 may be arranged to be protected from a fluid flow past the burner 102. The inertial electrode 112 may be configured as a flame holder for the flame 104. The arrangement for protection of the orifice 404 from the fluid flow past the burner 102 may include positioning the inertial electrode launcher 110 in the lee of a physical fluid flow barrier (not shown). The solid particles 406 may include comminuted coal, coke, or carbon. Additionally or alternatively, the solid particles 406 may be selected to react in the flame 104 or with combustion gas 116 produced by the flame 104.

Figure 5:
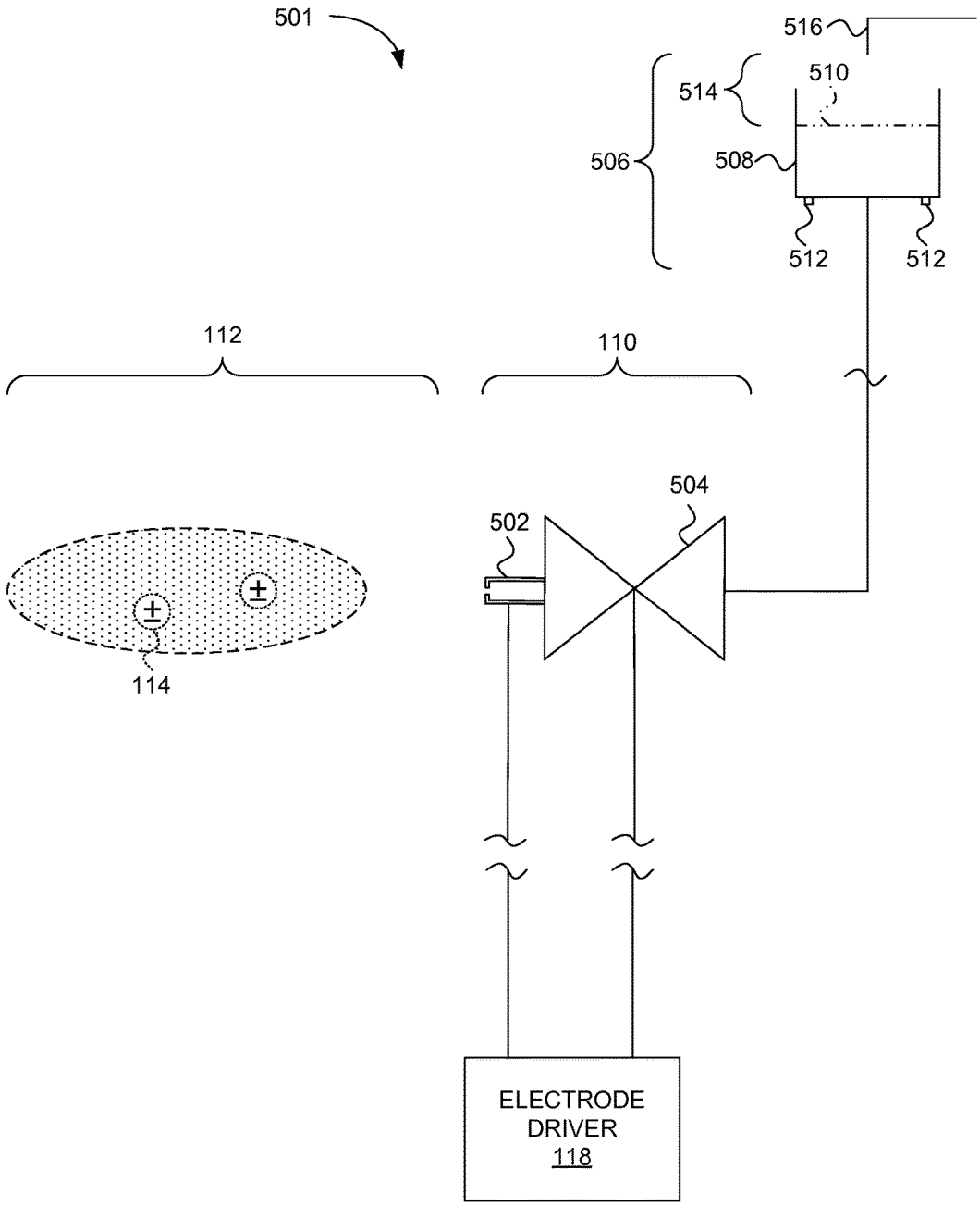
FIG. 5 is a diagram of an inertial electrode launcher including a nozzle configured to receive a voltage and project an inertial electrode including a liquid carrying the voltage or one or more charged particles corresponding to the voltage, according to an embodiment.

FIG. 5 is diagram showing an embodiment of the inertial electrode launcher 110 formed as a nozzle 502 configured to at least intermittently or periodically receive a voltage from the electrode driver 118 and to expel a fluid 510 carrying charged particles 114 and/or a voltage. The fluid 510 carrying the charged particles and/or voltage may form the inertial electrode 112. The fluid 510 may include a liquid such as water. The fluid 510 may include a buffer or be functionalized to hold the charge.

The burner system 101 may include a valve 504 operatively coupled to the electrode driver 118 and a fluid supply system 506 in communication with the nozzle 502 through the valve 504. The valve may be configured to respond to an actuation signal from the electrode driver 118 to at least intermittently or periodically open flow of the fluid 510 from a fluid supply system 506 to flow through the nozzle 502. The fluid supply system 506 may be configured to supply the fluid 510 to the nozzle 502 and maintain electrical isolation between the fluid 510 and a fluid source 516. The fluid supply system 506 may include tank 508 to hold the fluid 510, the tank being made of an electrically insulating material or being supported by electrical insulators 512 to isolate the fluid 510 from ground or another voltage. An antisiphon arrangement 514 may be configured to maintain electrical isolation between the fluid 510 and the fluid source 516.

Referring to FIGS. 1 and 5, the burner system 101 may include an object 126 configured to be held at a voltage disposed proximate to the flame 104 or combustion gas 116 produced by the flame 104. A voltage sign to which the nozzle 502 is driven and the majority charge sign of the fluid charges 114 carried by the inertial electrode 112 may be the same as a sign of the voltage held by the object 126. Alternatively, the voltage sign to which the nozzle 502 is driven and the majority charge sign of the fluid charges 114 carried by the inertial electrode 112 may be opposite of a sign of the voltage held by the object 126.

The fluid may form the inertial electrode 112 as a stream emitted from the nozzle 502. An actuator (not shown) operatively coupled to the electrode driver 118 may be configured to align the nozzle 502 to an intended direction of travel of the inertial electrode 112.

Figure 6:
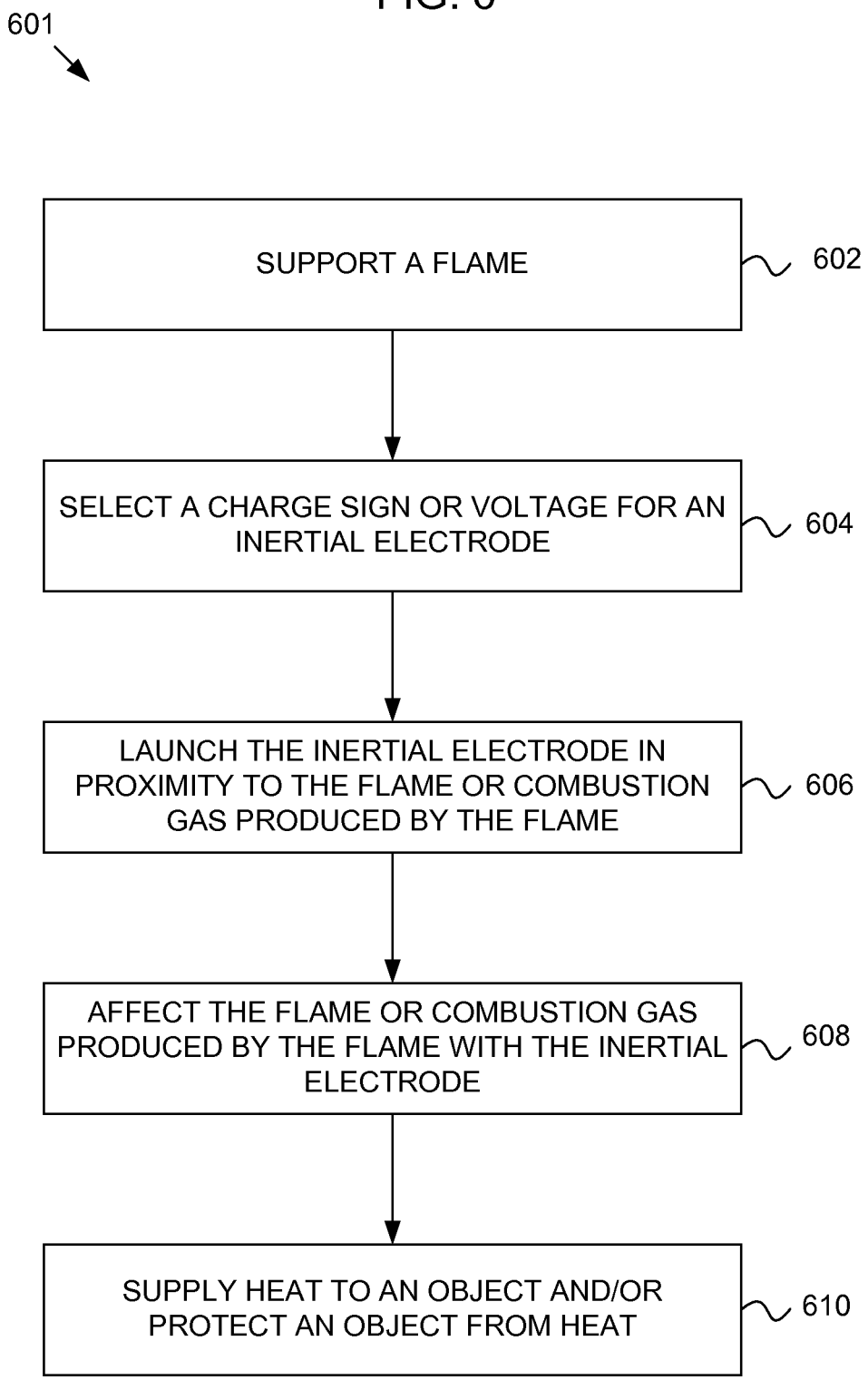
FIG. 6 is a flow chart showing a method for operating a burner including an inertial electrode launcher, according to an embodiment.

FIG. 6 is a flowchart showing a method 601 for operating a burner system 101, according to an embodiment. The method 601 may begin with step 602 wherein a flame may be supported with a burner. Proceeding to step 604, a charge sign or voltage maybe be selected for an inertial electrode. Selecting a charge sign or voltage for the inertial electrode may include selecting a sequence of different charge signs or voltages. Selecting a charge sign or voltage for the inertial electrode may include selecting a time-varying sign of the charged particles or voltage carried by the inertial electrode.

For example, step 604 may include selecting an alternating current (AC) voltage waveform, a chopped DC waveform, or other time-varying or periodic voltage that imparts a charge, charge concentration, or voltage variation on the inertial electrode.

Proceeding to step 606, the inertial electrode may be launched in proximity to the flame or a combustion gas produced by the flame. A selected time-varying sign of the charged particles or voltage selected in step 604 may be carried by the inertial electrode launched in step 606. For inertial electrodes that are non-continuous, the start of inertial electrode projection may include a voltage or charge concentration corresponding to the portion of the waveform corresponding to onset of electrode projection, with the charge concentration or voltage in the inertial electrode then varying with the voltage applied to the inertial electrode launcher until the inertial electrode projection is again shut off. Alternatively, a voltage applied to all or a portion of the inertial electrode launcher may be held continuous, and the timing of an application of a correspondingly charged or voltage carrying inertial electrode into proximity to the flame or the combustion gas produced by the flame may be determined by controlling the timing of inertial electrode "on" and inertial electrode "off" times.

Proceeding to step 608, the flame or the combustion gas produced by the flame may be affected by the inertial electrode. For example, the flame or the combustion gas produced by the flame may include at least transiently present charged particles (such as in charge-balanced proportion or as a majority charge). A variety of ways for the flame or the combustion gas produced by the flame to be affected by the inertial electrode are contemplated. For example, the inertial electrode may affect a rate of reaction by interaction in the flame or the combustion gas produced by the flame. Additionally or alternatively, a shape of the flame or a flow direction of the combustion gas may vary responsively to the inertial electrode.

The inertial electrode may cause the flame or combustion gas produced by the flame to preferentially transfer heat to an object. The object may be electrically grounded. The inertial electrode may impart electrically charged particles onto the flame or the combustion gas produced by the flame such that the electrically charged particles and the heat from the flame or the combustion gas produced by the flame is electrically attracted to the electrically grounded object to preferentially provide the heat.

Additionally, step 608 may include applying an electrical potential to the object. Applying an electrical potential to the object may affect the flame or the combustion gas produced by the flame with the inertial electrode. This may preferentially transfer heat to the object and may include imparting electrically charged particles onto the flame or the combustion gas produced by the flame such that the electrically charged particles and the heat from the flame or the combustion gas produced by the flame may be electrically attracted to the electrical potential applied to the object. Alternatively (or intermittently), the inertial electrode may be operative to protect the object from heat. For example, the inertial electrode may impart electrically charged particles onto the flame or the combustion gas produced by the flame such that the electrically charged particles and the heat from the flame or the combustion gas produced by the flame are electrically repelled from the electrical potential applied to the object.

Proceeding to step 610, heat from the flame or from the combustion gas produced by the flame may be supplied to an object. In step 610 an object may additionally or alternatively be protected from heat from the flame or the combustion gas produced by the flame. For example, heat from the flame or the combustion gas produced by the flame may be supplied to an electrical power generator, a turbine, a chemical process plant, a boiler, a water heater, a furnace, a land vehicle, a ship, or an aircraft. Protection from heat may be enabled for purposes of throttling an effect, for shutting down a process, or for protecting the object from overheating.

Optionally, the method for operating a burner system 601 may include applying an electrical potential to a second object (not shown) spaced away from a first object. In step 608 affecting the flame or the combustion gas produced by the flame with the inertial electrode to protect the first object from heat from the flame or the combustion gas produced by the flame may be performed by selecting a sign for the electrically charged particles and therefore the heat from the flame or the combustion gas produced by the flame to be electrically attracted to the electrical potential applied to the second object spaced away from the first object protected from the heat.

Optionally, the inertial electrode launcher may be protected from exposure to a fluid flow past the flame. Affecting the flame or combustion gas produced by the flame in step 608 may include providing flame holding with the inertial electrode. For example, protecting the inertial electrode launcher from exposure to the fluid flow past the flame may include positioning the inertial flame holder and/or at least a portion of the inertial electrode in the lee of a physical fluid flow barrier.

Step 608, affecting a shape or location of the flame with the inertial electrode may include affecting a concentration of the charged particles in the flame or the combustion gas produced by the flame. Additionally, step 608 may include reacting at least a portion of the inertial electrode with the flame or the combustion gas produced by the flame. In some embodiments, the burner may be held or driven to a voltage such as ground. Interactions between the flame and the inertial electrode may be based on differences between a majority charge or a voltage carried by the inertial electrode and the balanced charge or (e.g., ground) voltage carried by the flame or the combustion gas produced by the flame.

As described above, various forms of inertial electrodes are contemplated.

In step 606, launching the inertial electrode may include launching a second flame comprising an inertial electrode (e.g., see FIG. 2). This may cause the second flame to carry an inertial electrode majority charge or an inertial electrode voltage.

Alternatively, as illustrated in FIG. 3, launching the inertial electrode in step 606 may include vaporizing a liquid or other vaporizing material with a high voltage. Vaporization may be performed by applying a biased voltage through the vaporizing material between electrodes. The vaporization may project a vapor or an aerosol carrying charges corresponding to the voltage bias.

Alternatively, step 606 may include propelling charged solid particles, as shown in FIG. 4. The charged solid particles may carry a majority charge and may collectively form the inertial electrode. The solid particles may be entrained in a fluid stream. A majority charge may be deposited on the entrained solid particles, for example by passing the particles along or past a corona emission source such as a simple corona wire, a corotron, or a scorotron. The solid particles may include comminuted coal, coke, and/or carbon; and/or may include another material such as a salt selected to react with the flame and/or with a combustion byproduct.

Alternatively, launching an inertial electrode may include energizing a nozzle with an inertial electrode voltage and projecting a liquid from the nozzle. This approach is illustrated in FIG. 5, above. The liquid may include water, a buffered solution, a slurry, a gel, a fuel, and/or another material capable of flowing through the nozzle.

Optionally, the method 601 may include selecting or varying a direction of launch of the inertial electrode with an actuator (not shown). Additionally or alternatively, the method 601 may include selecting or actuating a timing, volume, flow duration, charge or voltage sign, or charge concentration of the inertial electrode.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A burner system, comprising:

a burner configured to support a burner flame, the burner flame carrying first charged particles;

at least one inertial electrode launcher including an orifice;

the at least one inertial electrode launcher configured to launch an inertial electrode through the orifice, in proximity to the burner flame or a combustion gas produced by the burner flame, the inertial electrode including second charged particles; and an electrode driver operatively coupled to the at least one inertial electrode launcher;

wherein the inertial electrode is configured to at least intermittently or periodically receive a voltage from the electrode driver to expel a portion of a fluid carrying the second charged particles;

wherein the portion of the fluid carrying the second charged particles forms the inertial electrode;

a charging apparatus configured to create the second charged particles;

wherein the inertial electrode launcher is configured to impart inertia onto the inertial electrode;

wherein the inertial electrode launcher further comprises an inertial electrode burner configured to at least intermittently or periodically support a flame inertial electrode; and wherein momentum imparted onto the inertial electrode is configured to cause the burner flame or the combustion gas produced by the burner flame to respond to the momentum carried by the inertial electrode.

2. The burner system of claim 1, wherein the charged particles carried by the inertial electrode are configured to impart a majority charge on the burner flame or on the combustion gas produced by the burner flame.

3. The burner system of claim 1, wherein the inertial electrode is configured to affect a shape or location of the burner flame.

4. The burner system of claim 1, wherein the inertial electrode is configured to affect a concentration of the first charged particles in the burner flame or in the combustion gas produced by the burner flame.

5. The burner system of claim 1, wherein the second charged particles carried by the inertial electrode are configured to interact with first charged particles carried by the burner flame or by the combustion gas produced by the burner flame.

6. The burner system of claim 1, wherein the momentum imparted onto the inertial electrode has a direction and the direction is aligned to the orifice.

7. The burner system of claim 1, further comprising: an electrode driver configured to control and operate one or more function or operation performed by the at least one inertial electrode launcher.

8. The burner system of claim 7, wherein the electrode driver is configured to periodically or intermittently change a concentration of the second charged particles or the voltage carried by the inertial electrode.

9. The burner system of claim 7, wherein the electrode driver is configured to periodically or intermittently change a sign of the second charged particles or the voltage carried by the inertial electrode.

10. The burner system of claim 7, wherein the at least one inertial electrode launcher further comprises: a directional actuator configured to determine a direction the inertial electrode is launched by the at least one inertial electrode launcher; wherein the electrode driver is configured to control the directional actuator.

11. The burner system of claim 7, wherein the at least one inertial electrode launcher further comprises: a location actuator configured to determine a location from which the inertial electrode is launched by the at least one inertial electrode launcher; wherein the electrode driver is configured to control the location actuator.

12. The burner system of claim 1, further comprising an object configured to be heated by or configured to be protected from heating by the burner flame or the combustion gas produced by the burner flame.

13. The burner system of claim 12, wherein the object is electrically grounded.

14. The burner system of claim 12, wherein the object is driven to or held at a voltage having an opposite sign compared to a sign of the second charged particles or the voltage carried by the inertial electrode.

15. The burner system of claim 12, wherein the object is driven to or held at a voltage having a same sign compared to a sign of the second charged particles or the voltage carried by the inertial electrode.

16. The burner system of claim 12, wherein the object is insulated from ground and is not driven to a voltage different than a voltage imparted by cooperation of the inertial electrode with the burner flame or the combustion gas produced by the burner flame.

17. The burner system of claim 1, wherein the at least one inertial electrode launcher comprises: a charging apparatus including a depletion electrode configured to attract charges from the flame inertial electrode to create a majority sign of the second charged particles carried by in the flame inertial electrode.

18. The burner system of claim 17, further comprising: an electrode driver configured to apply a voltage to the charging apparatus to control at least one of the majority sign or a concentration of the second charged particles in the inertial electrode.

19. The burner system of claim 17, further comprising: a valve configured to control a flow of fuel to the inertial electrode burner; and an electrode driver configured to control the valve.

20. The burner system of claim 17, further comprising: an electrical insulator or gap configured to electrically isolate the inertial electrode from ground or from another voltage.

21. The burner system of claim 1, wherein the orifice comprises a nozzle.

22. The burner system of claim 21, wherein the fluid includes a liquid.

23. The burner system of claim 21, wherein the fluid includes a buffer or is functionalized to hold a charge.

24. The burner system of claim 21, further comprising: a valve operatively coupled to the electrode driver; a fluid supply system in communication with the nozzle through the valve; wherein the valve is configured to respond to an actuation signal from the electrode driver to at least intermittently or periodically open flow of the fluid from the fluid supply system to flow through the nozzle.

25. The burner system of claim 21, further comprising: a fluid supply system configured to supply the fluid to the nozzle and to maintain electrical isolation between the fluid and a fluid source.

26. The burner system of claim 25, wherein the fluid supply system further comprises: a tank to hold the fluid, the tank being made of an electrically insulating material or being supported by electrical insulators to isolate the fluid from ground or from another voltage; and an antisiphon arrangement configured to maintain electrical isolation between the fluid and the fluid source.

27. The burner system of claim 21, further comprising: an object configured to be held at a voltage and disposed proximate to the burner flame or the combustion gas carried by the burner flame; wherein a voltage sign to which the nozzle is driven and a charge sign of the second charged particles carried by the inertial electrode is the same as a sign of the voltage held by the object.

28. The burner system of claim 21, further comprising: an object configured to be held at a voltage disposed proximate to the burner flame or the combustion gas carried by the burner flame; wherein a voltage sign to which the nozzle is driven and a charge sign of the second charged particles carried by the inertial electrode is opposite of a sign of the voltage held by the object.

29. The burner system of claim 21, wherein the fluid is conductive; and wherein the fluid is operative as an inertial electrode when it is in the form of a stream emitted from the nozzle.

30. The burner system of claim 21, further comprising: an actuator operatively coupled to the electrode driver; wherein the electrode driver is configured to align the nozzle to an intended direction of travel of the inertial electrode.

31. A method for operating the burner system of claim 1, comprising: supporting the burner flame with the burner; and launching the inertial electrode carrying the second charged particles or a voltage in proximity to the primary burner flame or to the combustion gas produced by the burner flame.

32. The method of claim 31, further comprising: selecting a charge sign of the second charged particles or the voltage carried by the inertial electrode.

33. The method of claim 32, wherein selecting a charge sign of the second charged particles or the voltage carried by the inertial electrode includes including a sequence of different charge signs or voltages.

34. The method of claim 32, wherein selecting a charge sign of the second charged particles or the voltage carried by the inertial electrode includes selecting a time-varying sign of the second charged particles or the voltage carried by the inertial electrode.

35. The method of claim 31, further comprising: affecting the burner flame or the combustion gas produced by the burner flame with the inertial electrode.

36. The method of claim 35, wherein the burner flame includes at least transiently present charged particles; and wherein affecting the burner flame or the combustion gas produced by the burner flame with the inertial electrode includes affecting a rate of reaction in the burner flame or the combustion gas produced by the burner flame by an interaction between the second charged particles or the voltage carried by the inertial electrode and the at least transiently present charged particles.

37. The method of claim 31, further comprising: supplying heat from the burner flame or from the combustion gas produced by the primary burner flame to a first object.

38. The method of claim 31, further comprising: protecting first object from heat from the burner flame or from the combustion gas produced by the burner flame.

39. The method of claim 38, further comprising: applying an electrical potential to the first object; wherein affecting the burner flame or the combustion gas produced by the burner flame with the inertial electrode to protect the first object from heat from the burner flame or from the combustion gas produced by the burner flame includes imparting electrically charged particles onto the burner flame or the combustion gas produced by the burner flame such that the electrically charged particles and heat from the burner flame or from the combustion gas produced by the burner flame are electrically repelled from the electrical potential applied to the first object.

40. The method of claim 38, further comprising: applying an electrical potential to a second object spaced away from the first object; wherein affecting the burner flame or the combustion gas produced by the burner flame with the inertial electrode to protect the first object from heat from the burner flame or from the combustion gas produced by the burner flame such that the electrically charged particles and heat from the burner flame or from the combustion gas produced by the burner flame are electrically attracted to the electrical potential applied to the second object spaced away from the first object.

41. The method of claim 31, further comprising: reacting at least a portion of the inertial electrode with the burner flame or the combustion gas produced by the burner flame.

42. The method of claim 31, wherein launching the inertial electrode further comprises: energizing a nozzle with an inertial electrode voltage; and projecting a liquid from the nozzle.

43. The method of claim 31, wherein launching the inertial electrode further comprises: actuating a direction of launch of the inertial electrode.

44. The method of claim 31, further comprising: supplying heat from the burner flame or from the combustion gas produced by the burner flame to an electrical power generator, a turbine, a chemical process plant, a boiler, a water heater, a furnace, a land vehicle, a ship, or an aircraft.

* * * * *